US006089238A

United States Patent [19]

Schneider et al.

[11] Patent Number: 6,089,238

[45] Date of Patent: Jul. 18, 2000

[54] ULTRALIGHT COAXIAL CIGARETTE INCLUDING A MULTIPART FILTER

[75] Inventors: Werner Schneider, Quickborn; Adolf Schlüter, Eckersdorf-Donndorf; Erwin Kausch, Bayreuth; Volker Heemann, Goldronach; Ursula Köpke, Bayreuth; Wolfgang Metzner, Hamburg; Bernd-Henrik Müller, Heinersreuth; Heiner Ritter, Bremen, all of Germany

[73] Assignee: Brown & Williamson Tobacco Corporation, Louisville, Ky.

[21] Appl. No.: 09/081,580

[22] Filed: May 19, 1998

[30] Foreign Application Priority Data

May 30, 1997 [DE] Germany ..... 197 22 812

[51] Int. Cl.[7] ..... A24D 3/04

[52] U.S. Cl. ..... 131/338; 131/336; 131/341; 131/360; 131/364

[58] Field of Search ..... 131/331, 332, 131/336, 338, 341, 360, 364

[56] References Cited

U.S. PATENT DOCUMENTS

| | | | |
|---|---|---|---|
| 4,874,004 | 10/1989 | Borowski . | |
| 5,265,626 | 11/1993 | Schneider et al. . | |
| 5,379,789 | 1/1995 | Schneider et al. . | |
| 5,439,011 | 8/1995 | Schneider | 131/336 |
| 5,549,125 | 8/1996 | White | 131/336 |
| 5,730,160 | 3/1998 | Schneider | 131/360 |

FOREIGN PATENT DOCUMENTS

| | | |
|---|---|---|
| 474940 | 3/1992 | European Pat. Off. . |
| 503461 | 9/1992 | European Pat. Off. . |
| 539191 | 4/1993 | European Pat. Off. . |
| 588166 | 9/1993 | European Pat. Off. . |
| 579410 | 1/1994 | European Pat. Off. . |
| 3743597 | 2/1989 | Germany . |
| 3901226 | 7/1990 | Germany . |
| 4127420 | 2/1993 | Germany . |
| 4205658 | 8/1993 | Germany . |

*Primary Examiner*—Stanley S. Silverman
*Assistant Examiner*—Michael P. Colaianni
*Attorney, Agent, or Firm*—Middleton & Reutlinger; John F. Salazar; Charles G. Lamb

[57] ABSTRACT

The invention relates to a coaxial cigarette including a coaxial tobacco rod comprising a rod core, a rod core wrapping, a rod jacket and a rod jacket wrapping and a multi-part ventilated filter wherein the filter comprises a filter wrapping as well as at least two longitudinal segments of which at least one is a coaxial filter segment having a core element, a core element wrapping and a jacket element and wherein the ratio of the resistance to draw of the rod core to the resistance to draw of the rod jacket is greater than unity and preferably in the range of 2 to 4.

9 Claims, 1 Drawing Sheet

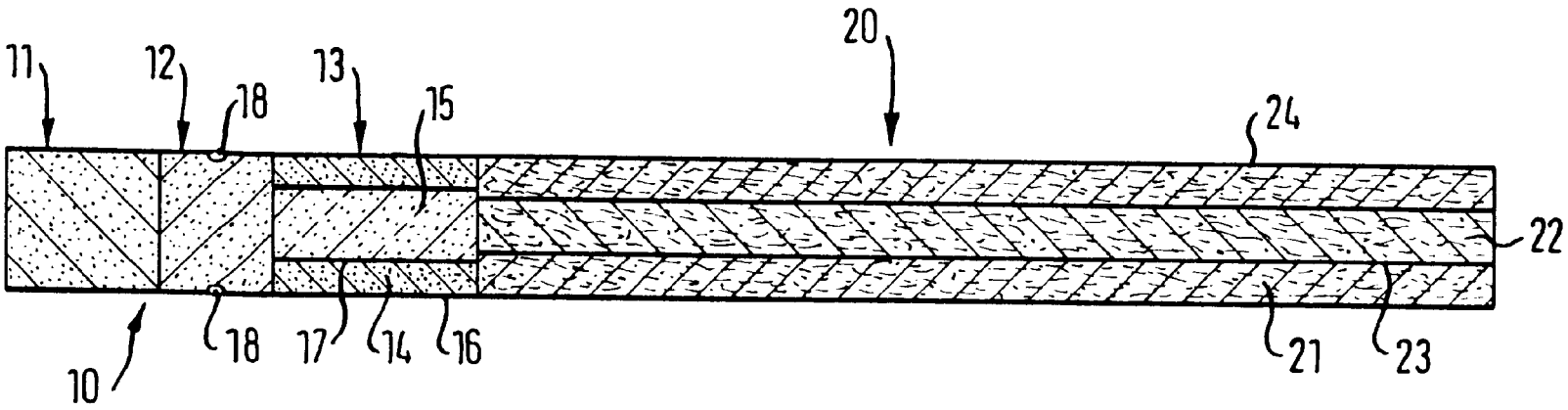
11
12
18
13
15
20
24
22
10
18
17
14
16
21
23

ULTRALIGHT COAXIAL CIGARETTE INCLUDING A MULTIPART FILTER

BACKGROUND OF THE INVENTION

1. Field of the Invention

The present invention relates to a coaxial cigarette comprising a coaxial tobacco rod comprising a rod core, a rod core wrapping, a rod jacket and a rod jacket wrapping, and a multipart ventilated filter.

2. Discussion of the Prior Art

A coaxial cigarette in which both the filter and the tobacco rod are configured coaxially is known from DE 41 27 420 C1. The configuration of this cigarette permits a reduction in the side smoke. The filter consists of only a single coaxial longitudinal segment.

A ventilated coaxial cigarette is likewise known from DE 37 43 597 C1. This cigarette in turn comprises a ventilated coaxial filter consisting of only a sole longitudinal segment. Undesirable smoke constituents are avoided by the use of combustion salts.

A further coaxial cigarette is known from DE 39 01 226 C1. By adjusting the filtration capacity in the filter core and filter jacket of this coaxial filter taste perception is optimized.

Known from EP 0 539 191 B1 are lightweight cigarette filters and cigarettes including these filters, whereby the filters are configured in multiparts by various longitudinal compartments. The tobacco rods employed are not configured coaxially. EP 0 474 940 A1 also shows such filter configurations for non-coaxial cigarettes.

SUMMARY OF THE INVENTION

It is a drawback in prior art as cited above that no cigarette configured fully coaxially has yet been specified which is specially suitable as an ultralight cigarette.

The usual problem in developing an ultralight cigarette is achieving a very low condensate value (specifically 1 mg) within the scope of the achievable ventilation and having a smoker-acceptable draw, it being the latter that restricts the use of filters having an extremely high filter capacity since material having a high filter efficiency also has a high specific resistance to draw.

The problem of achieving the very low condensate values is further aggravated when for reasons of taste a certain coaxial filter segment is used juxtaposed to a coaxial tobacco rod since the coaxial segment as described in this case necessarily does not have a very high retention in the outer jacket and thus also has a retention as a whole which is lower than that as would be typically selected for the filter of a 1 mg cigarette.

The object of the present invention is to define a coaxial cigarette which can be optimally configured as an ultralight cigarette.

This object is achieved for a cigarette of the kind cited in that the filter of the coaxial cigarette comprises a filter wrapping as well as at least two longitudinal segments of which at least one is a coaxial filter segment including a core element, a core element wrapping and a jacket element, and in that the ratio of the resistance to draw of the rod core to the resistance to draw of the rod jacket is greater than unity and preferably in the range 2 to 4.

This defines to advantage a coaxial cigarette which due to its filter configuration and the adjustment of the parameters for the coaxial components of the tobacco rod is optimally suited as a cigarette for the ultralight market segment.

The special feature of the invention is that both the effects of the coaxial segments (of rod and filter) and achieving a very low condensate value materialize with positive assessment of the taste and draw of the cigarette, it being the particular specifications of the individual segments and the specific combination of the individual segments that serve this purpose.

It is particularly of advantage when coaxial cigarettes in accordance with the present invention comprise one or more of the following features in combination:

- the filter coaxial segment is the filter element at the tobacco end;
- the core element consists of cellulose acetate, paper or crest with a non-ventilated retention of 65 to 95%;
- the core element wrapping is substantially impermeable to air;
- the jacket element consists of cellulose acetate or other suitable material having a low non-ventilated retention of 15 to 50%;
- the resistance to draw of the jacket element is in the range of 80 to 150 mm WC;
- the resistance to draw of the core element is in the range of 160 to 450 mm WC;
- a cellulose acetate jacket element has a single denier of 2.5 to 5 dpf;
- a cellulose acetate core element has a single denier of 1.5 to 2.1 dpf.

Preferably the resistance to draw of the coaxial filter segment is in the range of 45 to 120 mm WC.

A non-ventilated coaxial filter segment is used preferably.

In accordance with a preferred embodiment of the coaxial cigarette in accordance with the invention the filter comprises three longitudinal segments, namely a mouth-end segment having low retention, a middle segment having high retention and a coaxial filter segment at the tobacco end.

The middle filter segment of the coaxial cigarette in accordance with the invention consists in accordance with a preferred embodiment of a filter material such as paper, crest or preferably cellulose acetate, features a resistance to draw of 30 to 100 mm WC, preferably 50 to 60 mm WC, and its single denier for the cellulose acetate is in the range of 1.5 to 5 dpf, preferably in the range of 1.5 to 2.1 dpf.

In this arrangement the mouth-end segment of the filter of a coaxial cigarette in accordance with the invention consists preferably of filter material such as paper, crest or, more preferably, cellulose acetate. Likewise a hollow filter tip may be provided. The resistance to draw of the mouth-end segment is in the range of 0 (hollow filter tip) to 100 mm WC and preferably in the range of 10 to 15 mm WC.

The coaxial tobacco rod of the coaxial cigarette in accordance with the invention comprises to advantage one or more of the following features in combination:

- total rod resistance to draw is in the range of 30 to 100 WC, preferably 50 mm WC;
- the air permeability of the rod jacket wrapping is in the range of 15 to 300 CU (Coresta units), preferably in the range of 50 to 100 CU;
- the rod jacket wrapping contains combustion salts such as Na acetate or K citrate, preferably K citrate in a range of 1 to 2.5%, more particularly approx. 1.75%;
- the rod core wrapping consists of sheet tobacco or cigarette paper having an air permeability of 0 to 50 CU, preferably 0 to 5 CU;
- the taste-relevant tobaccos are arranged preferably in the rod jacket.

All of the features as described above for the coaxial cigarette in accordance with the invention contribute individually or in combination towards defining a coaxial cigarette particularly suitable for the ultralight market segment, it being both the cited material parameters and the arrangement features for the various components of the cigarette that contribute towards achieving this object.

In accordance with a preferred embodiment the filter of the coaxial cigarette in accordance with the invention has an overall length of 21 to 31 mm and preferably 27 mm, whereby individual dimensioning is as follows:

the mouth-end segment has a length of 4 to 16 mm, preferably 9 to 15 mm, the middle segment has a length of 0 to 12 mm, preferably 3 to 7 mm and the tobacco-end segment has a length of 7 to 16 mm, preferably 8 to 13 mm.

The ventilation perforations may be produced on-line by laser perforation, it being likewise conceivable to use preperforated filter wrappings. The ventilation perforations are arranged preferably in the portion of the middle segment; however, if the length of the mouth-end segment exceeds 11 mm, the ventilation perforations may also be arranged in the portion of the mouth-end segment.

The filter ventilation rate is preferably in the range of 50 to 85%.

As regards the diameter of the filter, this may be in the range of 7 to 9 mm and preferably 7.8 mm, the core element of the coaxial filter segment having a diameter of 4 to 6 mm and preferably 5 to 6 mm.

The tobacco rod of a coaxial cigarette in accordance with the invention in one preferred configuration has a diameter in the range of 7 to 9 mm and is preferably 7.8 mm. In this arrangement the rod core of the coaxial cigarette may have a diameter of 4 to 6 mm and preferably 5 to 5.6 mm.

BRIEF DESCRIPTION OF THE DRAWINGS

A better understanding of the invention will be had upon reference to the following description in conjunction with the accompanying drawings in which like numerals refer to like parts and wherein:

FIG. 1 is a cross-section through a coaxial cigarette in accordance with the invention.

DETAILED DESCRIPTION OF THE PREFERRED EMBODIMENT

The coaxial cigarette shown in the figure due to its construction be divided into a filter 10 and a tobacco rod 20.

The tobacco rod 20 is configured coaxially, it comprising from inside out the following components:

the rod core 22, the rod core wrapping 23, the rod jacket 21 and the rod jacket wrapping 24.

The tobaccos relevant to the taste of this cigarette are preferably arranged in the rod jacket 21. For the rod core wrapping sheet tobacco is preferably used. The resistance to draw of the rod core is higher than that of the rod jacket, this being achieved by a suitable selection of material and adjusting the parameters such as, for example, the packing density. Suitable values for the resistance to draw are approx. 150 mm WC for the rod core 22 and approx. 75 mm WC for the rod jacket 21, whilst the resistance to draw of the tobacco rod 20 as a whole is approx. 50 mm WC.

The tobacco rod has a usual outer diameter of approx. 7.8 mm, the rod core 22 is in the diameter range of 5 to 6 mm.

The filter 10 adjoins the tobacco rod 20, it comprising in the illustrated configuration three longitudinal segments 11, 12 and 13. The mouth-end longitudinal segment 11 of the filter 10 is a segment having low retention made of a filter material such as paper, crest or preferably cellulose acetate. Its resistance to draw is from approx. 10 to 15 mm WC.

Provided as the middle longitudinal segment 12 of the filter 10 is a filter plug, again of paper, crest or preferably cellulose acetate. The segment 12 features a high specific retention so that a retention of approx. 30% (non-ventilated) materializes even for the short middle longitudinal segment 12 for a resistance to draw of approx. 50 mm WC. In the example illustrated this middle segment 12 is the ventilated segment; ventilation perforations being indicated by 18.

The ventilation perforations 18 may be produced by on-line laser beam perforation, i.e. during the production process, there also being the possibility, however, of using preperforated coating paper for the filter. The ventilation perforations ensure a rate of filter ventilation in the range of 50 to 85%, more particularly 65%, they preferably being located in the mouth-end direction of this middle segment 12.

Located between the middle segment 12 and the tobacco rod 20 is then the coaxial filter segment 12 comprising a core element 15, a core element wrapping 17 and a jacket element 14.

The complete filter is surrounded by a filter wrapping 16, for instance of filter paper.

The core element 15 of the coaxial segment 13 consists of cellulose acetate having a retention of 65 to 95%, more particularly approx. 80% relative to a non-ventilated filter. The core element wrapping 17 is substantially non-permeable to air. The jacket element 14 consists of cellulose acetate or some other suitable material having a low retention of 15 to 50%, more particularly approx. 30%, again relative to the non-ventilated filter. The resistance to draw of the core element is higher than the resistance to draw of the jacket element 14 and is approx. 260 mm WC whilst the resistance to draw of the jacket element is approx. 14 to 120 mm WC.

The further material and dimensional specifications are in the range as indicated above. Suitably selecting these specifications makes it possible in accordance with the invention to provide a coaxial cigarette which is highly suitable for the ultralight market segment.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A Coaxial cigarette comprising:

a) a coaxial tobacco rod (20) comprising a rod core (22), a rod core wrapping (23), a rod jacket (21) and a rod jacket wrapping (24) and b) a multi-part ventilated filter (10), wherein c) said filter (10) comprises a filter wrapping (16) as well as at least three longitudinally extending segments longitudinally aligned along the longitudinal axis of the cigarette of which at least one segment is a tobacco end coaxial filter segment (13) having a core element (15), a core element wrapping (17) and a jacket element (14), a second segment is a mouth-end segment (10) having low retention and a third segment is a middle segment (12) having high retention and d) the ratio of the resistance to draw of said rod core (22) to the resistance to draw of said rod jacket is greater than unity and preferably in the range of 2 to 4.

2. The coaxial cigarette as set forth in claim 1 comprising a filter coaxial segment (13) and wherein:

said core element (15) consists of cellulose acetate with a non-ventilated retention of 65 to 95%;

said core element wrapping (17) is substantially impermeable to air;

said jacket element (14) consists of cellulose acetate having a low non-ventilated retention of 10 to 50%;

the resistance to draw of said jacket element (14) is in the range of 80 to 150 mm WC;

the resistance to draw of said core element (15) is in the range of 160 to 450 mm WC;

said cellulose acetate jacket element (14) has a single denier of 2.5 to 5 dpf; and, said cellulose acetate core element (15) has a single denier of 1.5 to 2.1 dpf.

3. The coaxial cigarette as set forth in claim 1, wherein said middle filter segment (12) consists of a filter material such as cellulose acetate, features a resistance to draw of 30 to 100 mm WC, preferably 50 to 60 mm WC, and its single denier for the cellulose acetate is in the range of 1.5 to 5 dpf, preferably in the range of 1.5 to 2.1 dpf.

4. The coaxial cigarette as set forth in claim 1, wherein said mouth-end segment (11) consists of a filter material such as cellulose acetate and features a resistance to draw of 0 to 50 mm WC, preferably 10 to 15 mm WC.

5. The coaxial cigarette as set forth in claim 1 including a coaxial tobacco rod and further comprising:

the total rod resistance to draw is in the range of 30 to 100 mm WC, preferably 50 mm WC;

the air permeability of said rod jacket wrapping (24) is in the range of 15 to 300 CU, preferably 50 to 100 CU;

said rod jacket wrapping (24) contains combustion/glowing salts such as Na acetate or K citrate, preferably K citrate in a range of 1 to 2.5%;

said rod core wrapping (23) consists of sheet tobacco or cigarette paper having an air permeability of 0 to 50 CU, preferably 0 to 5 CU;

the taste-relevant tobaccos are arranged preferably in said rod jacket (21).

6. The coaxial cigarette as set forth in claim 1 wherein said filter has an overall length of 21 to 31 mm, preferably 27 mm, including said mouth-end segment (11) having a length of 4 to 16 mm, preferably 11 to 13 mm, said middle segment (11) having a length of 4 to 12 mm, preferably 5 to 7 mm and said tobacco-end segment (13) having a length of 7 to 16 mm, preferably 8 to 10 mm, ventilation perforations (18) produced preferably by laser perforation or by use of preperforated filter wrapper being arranged in the portion of said middle segment (12) or more particularly in the portion of said mouth-end segment (11), when the length of said mouth-end segment (11) exceeds 11 mm, and the filter ventilation rate being in the range of 50 to 85%.

7. The coaxial cigarette as set forth in claim 1, wherein the diameter of said filter (10) is in the range of 7 to 9 mm, preferably 7.8 mm, said core element (15) of said coaxial filter segment (13) having a diameter of 4 to 6 mm and preferably 5 to 6 mm.

8. The coaxial cigarette as set forth in claim 1, wherein said tobacco rod (20) has a diameter in the range of 7 to 9 mm, preferably 7.8 mm, said rod core (22) having a diameter of 4 to 6 mm, preferably 5 to 5.6 mm.

9. The coaxial cigarette as set forth in claim 1, wherein said coaxial filter segment (13) has a resistance to draw in the range of 45 to 120 mm WC.

* * * * *